United States Patent [19]

Ulmer

[11] Patent Number: 5,067,219

[45] Date of Patent: Nov. 26, 1991

[54] FAN BLADE REMOVER

[76] Inventor: Peter F. Ulmer, P.O. Box 435, Empire, La. 70050

[21] Appl. No.: 603,959

[22] Filed: Oct. 22, 1990

[51] Int. Cl.[5] ..... E21B 19/00

[52] U.S. Cl. ..... 29/252

[58] Field of Search ..... 29/252, 266, 263, 282; 254/29 A, 93 R

[56] References Cited

U.S. PATENT DOCUMENTS

| | | | |
|---|---|---|---|
| 3,061,916 | 11/1962 | Kretz | 29/252 |
| 4,279,068 | 7/1981 | Altmayer | 29/252 |
| 4,406,182 | 9/1983 | Antone | 29/266 |
| 4,901,418 | 2/1990 | Machado et al. | 29/266 |

*Primary Examiner*—Robert C. Watson

*Attorney, Agent, or Firm*—Richard C. Litman

[57] ABSTRACT

A fixture for removing a rusted hub or collar from the end of a shaft, especially a fan from a motor shaft, comprises the following: a cylindrical body with a deep longitudinal groove adapted to accept the motor shaft in the center of the body (in such a position that the body axis and shaft axis are colinear); clamps to hold the shaft tight in the groove; hydraulic pistons in bores in the body, the pistons emerging from an end of the body adjacent the hub; and a plate attached to the exterior piston ends, for bearing against the hub. When pressurized fluid is admitted to galleries in the body, force is exerted upon the pistons, which force the plate against the hub. Since the body is clamped to the shaft, the hub is forced along the shaft and off the end. The invention is adapted to fit in the restricted space between a motor and a fan where ordinary tools cannot reach. The clamps may be simply screws threaded through the body to bear against the shaft within the groove.

14 Claims, 2 Drawing Sheets

FAN BLADE REMOVER

FIELD OF THE INVENTION

The present invention relates to tools for removing from a shaft a hub or collar gripping the shaft. Such hubs are found on gears, wheels, bearings, and the like. The present invention is especially useful for removing fan blades having blades radially distributed about a hub.

DESCRIPTION OF THE PRIOR ART

Radial fans with hubs attached to motor shafts are often troublesome to remove from the shaft. Apart from the usual problems of damage and corrosion (which often create difficulties in removing a collar or hub from a shaft), fans have the added complication of large and somewhat delicate fan blades extending from the hub in all directions. These blades render unusable many standard tools, such as pullers.

Some patents related to this art are listed before.

Grange, in U.S. Pat. No. 1,548,136, teaches hydraulic means to remove a band from a cylinder.

Tilssner, in U.S. Pat. No. 1,756,891, shows a puller using an hydraulic piston in combination with a screw to exert hydraulic force.

Prince, in U.S. Pat. No. 4,542,570, discloses an indented shelf which is slid under a fan blade hub with the shaft resting in the indentation. The shelf then may be pushed up at either end by jacks, while the motor and shaft is pulled downward, to separate the hub from the shaft. This device is bulky and requires a floor or table with means for holding down the shaft or motor it is attached to, and two jacks or the like to push upwards. Because force is exerted on the motor rather than on the shaft directly, it is possible that the motor may be damaged, or the motor shaft even pulled out.

Ellis, et al, in U.S. Pat. No. 1,688,535, shows a puller having gripping arms for gripping the edges of a hub. The arms are radially disposed about an extending column for exerting force on the shaft within the hub. Unlike the usual puller found in auto parts stores, which employs a simple screw to move the column, Ellis's device uses an hydraulic force multiplier in tandem with a screw. The hydraulic part contains a small piston attached to the screw, and a larger piston attached to the column. The bores of the pistons are coaxial and disposed within a single elongated piece. Hydraulic fluid fills the space between the pistons. This device, while multiplying the force, is unsuitable for most fan hubs because the arms interfere with the blades. Also, many fan blades have no shoulder suitable for gripping with this device. In addition, it requires much space in front of the fan for positioning, and is so useless if the fan is close to a surface or screen.

Harp, in U.S. Pat. No. 2,978,167 teaches a fan hub riding on a secondary shaft coaxial, or aligned with, the primary shaft from the fan motor. The two shafts are both inserted into a cylindrical arbor for driving the fan, leaving a cavity between the ends of the shafts. When the fan is to be removed, a grease gun is applied to a grease nipple at the outer end of the shaft carrying the fan hub, and grease is injected through a hole bored along the axis of this shaft into the cavity. The pressure of the injected grease pushes the shaft out of the arbor and frees both the shaft and the fan hub attached to it.

Harp's device is a special fan construction. It is not a tool useful for the removal of any fan hub.

None of the above inventions and patents, taken either singly or in combination, is seen to describe the instant invention as claimed.

The general problem of removing a fan hub is not solved by any of the above devices.

The removal of a fan hub requires a tool which can exert considerable axial force parallel to a shaft, in order to push off a hub. The force must overcome friction, rust, shaft bending, and other conditions. The above devices exert such large forces.

However, they do not meet the other requirements of a useful fan blade remover. Most importantly, a remover should not damage the fan blade or the motor. Also, a fan typically has a narrow space between the motor and the blades. Most ordinary pullers and pressing tools cannot fit within this space.

Accordingly, one object of the present invention is a fan blade hub removal tool which exerts great force between a motor shaft and a fan hub when emplaced between the two, without exerting any damaging forces on either the fan blades or motor.

Another object of the present invention is a remover which is compact, easy to use, and requires no special fixtures or unusual power sources.

Still another object of the present invention is a remover that causes no damage to the shaft of the motor.

A further object of the present invention is a remover that adapts to a large number of common fan shafts and hubs.

These and other objects of the present invention will become readily apparent upon further review of the following specification and drawings.

SUMMARY OF THE INVENTION

The present invention is a fan blade remover for inserting between a motor and a fan blade mounted on the end of an electric motor shaft, to remove the fan blade hub from the shaft end.

The invention has a body in the shape of a cylinder with a large and deep longitudinal groove, the bottom of the groove adapted to hold the motor shaft coaxial with the cylindrical body. This groove is of a width slightly greater than the width of the shaft of the motor. The bottom of the groove is preferably semi-circular in section.

The body is placed onto a motor shaft near the fan blade hub so that the shaft lies in the bottom of the groove with the shaft and the body cylinder coaxial.

Means are provided for clamping the body to the shaft. In the preferred embodiment the body is threaded to accept screws which bear against the shaft and hold it in the bottom of the groove. (In an alternative embodiment, hydraulic clamps such as hydraulic clamping pistons bear against the shaft.)

The body also contains two hydraulic pistons riding in bores parallel to the body cylinder axis, and disposed on either side of the shaft. These pistons are joined to a heavy plate having the same outlines as the body.

Pressure is applied to these pistons through an hydraulic coupling. The plate is forced away from the body into contact with the hub of the fan, and forces it off the end of the shaft.

Because the two pistons are of equal size and symmetrically placed, no torques are exerted on the hub, and there is no danger of cocking or bending.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
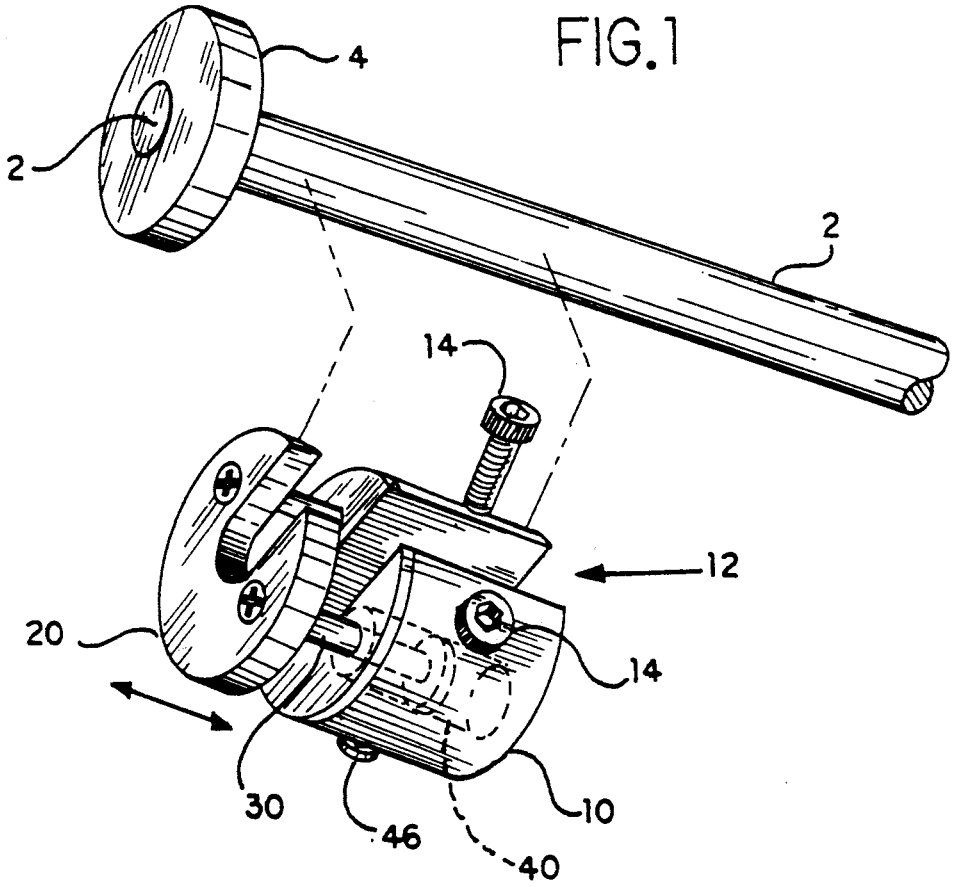
FIG. 1 is a perspective view of the remover. A shaft and hub are exploded out of their position in the groove running through the body of the remover. Also shown are the plate and hold-down screws.

The present invention, a remover to loosen fan blade hubs from the shafts of drive motors, is shown in perspective in FIG. 1. An electric motor shaft 2 and fan blade hub 4 are exploded out of the invention, pictured below. The hub 4 is frictionally held onto the shaft 2. It is to be pushed off by the invention.

The remover consists of a cylindrical body 10 including a longitudinal groove 12 into which the shaft 2 fits. The groove is preferably of a width slightly greater than the diameter of the shaft 2. The bottom of the groove 12 may be semi-circular to fit the shaft upon insertion. (Regardless of particular shape, the shaft 2 should lie in the bottom of the groove 12 in such a way that the axis of the shaft 2 is between the two pistons 30 which exert forces. This results in balanced force, as discussed below.)

The groove is sized to accept a typical electric motor shaft. Shafts of larger diameter would require another remover; those of smaller diameter might require fixtures to adapt the smaller shaft to the groove 12.

The shaft 2 is held firmly in the groove 12 by set screws 14, which bear down on the shaft from either side when tightened. The screws travel in threaded holes bored at appropriate angles through the body 10. These screws 14 prevent motion between the body 10 and the shaft 2, without damaging the shaft 2.

With the shaft 2 fixed to the body 10 in the groove 12, the hub 4 may be forced off. Hydraulic or pneumatic pressure from an outside source, such as a hand pump, is used to exert the needed force on the hub, using the elements discussed below.

A plate 20, having a groove like that of the body 10, likewise partially surrounds the shaft 2 when it is inserted into the body 10. The remover is placed and fastened on the shaft 2 so that the plate 20 is adjacent the hub 4.

Figure 2:
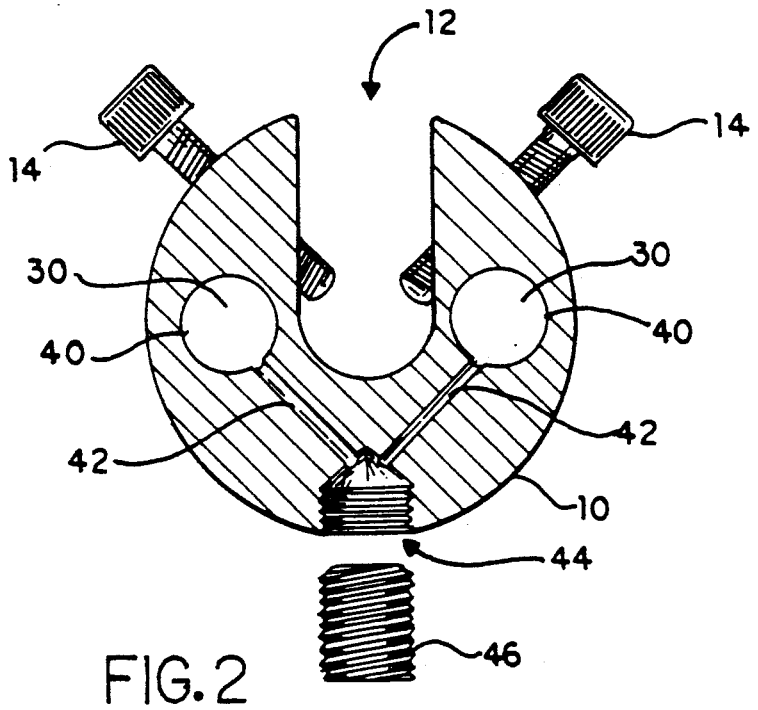
FIG. 2 is a cross section of the body of the invention showing the groove, hold-down screws, and hydraulic galleries and piston bores.

The plate 20 is fixed to two pistons 30, which penetrate the body 10 and slide in piston bores 40, shown in FIG. 2. Fluid under pressure is admitted to the bores, pushing the pistons 20 out of the body 10 and causing the plate 20 to bear against the hub 4 and remove it from the shaft 2.

Sealing of the pistons against leakage may be accomplished by ordinary means, such as O-rings.

FIG. 2 (a cross-sectional view) shows the path of pressurized fluid through the body. Bores 40, containing pistons 30, connect with galleries 42 which join in a threaded hole 44. A fitting 46 for adapting to an hydraulic line is shown out of the hole 44.

Figure 3:
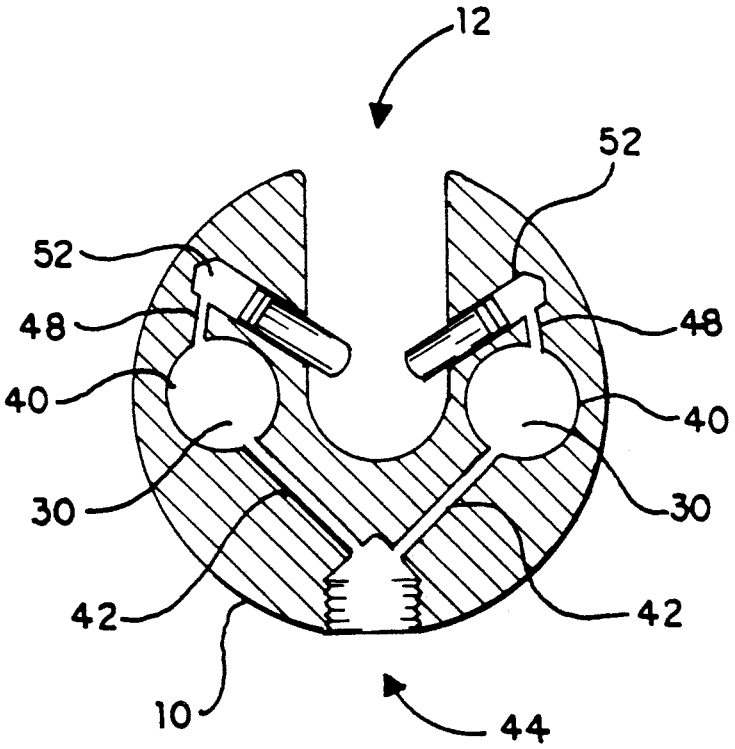
FIG. 3 is similar to FIG. 2 but shows hydraulic hold-down clamp instead of screws.

The hydraulic pressure which is used to force the hub can also be used to clamp the body 10 to the shaft 2. This alternate embodiment is shown in FIG. 3. Clamping pistons 50 slide in bores 52 within the body 10 to bear against the shaft 2. The same pressure source can of course supply both clamping and hub forces; pressurized fluid from the galleries 42 is passed on through galleries 48 to clamping piston bores 52. Thus, when pressure is applied the shaft is clamped and the hub forced off at once.

The remover is simple in operation. It is placed onto the shaft, with the plate 20 touching or close to the hub 4; alignment is automatic if the shaft diameter is close to the diameter of the groove bottom. The screws 14 are tightened (if screws instead of clamping pistons are used). An hydraulic or pneumatic pressure line is connected to the hole 44, pressure is applied, and the hub is forced off.

The invention is capable of exerting large forces, since it is robustly constructed of steel or the like. Large pressures may be applied without damage. The requisite force may be designed into the remover by sizing the pistons appropriately, given a certain available pressure.

The two pistons 30 should be of equal area to exert equal force, and should be situated symmetrically; that is, their centers should be situated along a line passing through the center of the shaft 2 when the shaft lies in its fixed position at the bottom of the groove 12, and, the pistons centers should be equidistant from the shaft center. This arrangement insures that the two forces together exert only a force in the direction of the shaft axis, and do not exert any torques which would tend to cock the hub on the shaft.

If more than two pistons are employed, they should be equally spaced about the center both in distance and in angle, for the same reason.

It is to be understood that the present invention is not limited to the sole embodiment above, but encompasses any and all embodiments within the scope of the following claims.

I claim:

1. A remover for removing a hub from a shaft by exerting a repulsive force between said shaft and said hub thereupon, comprising:

a body;

a groove extending through said body, said groove defining a U-shaped groove outline and including a substantially straight bottom, said groove adapted to accept said shaft within said bottom of said groove;

clamping means for preventing relative motion of said body and said shaft when said shaft lies in said bottom of said groove;

a generally planar plate slidably attached to said body, and adapted to move relative to said body in a direction parallel to said bottom of said groove.

said plate generally perpendicular to said bottom of said groove;

an indentation in said plate defining a U-shaped indentation outline congruent with said groove outline to pass said shaft therethrough when said shaft lies in said bottom of said groove; and force means for exerting said repulsive force between said body and said plate to remove said plate in said direction parallel to said bottom of said groove away from said body, said force means symmetrically disposed about said shaft;

whereby, said shaft may be laterally inserted into said groove and when said shaft lies in said bottom of said groove and said clamping means are engaged, said plate may exert said repulsive force on said hub, and said hub may be moved relative to said shaft.

2. The remover as in claim 1 wherein said clamping means includes screws engaging threaded holes in said body, said screws and said holes adapted to hold said shaft within said bottom of said groove upon turning of said screws, said screws and said holes perpendicular to and intersecting a shaft axis of said shaft when said shaft is held within said bottom of said groove.

3. The remover as in claim 1 wherein said body is cylindrical, and a shaft axis of said shaft is colinear with a body axis of said body when said shaft lies in said bottom of said groove.

4. A remover for removing a hub from a shaft by exerting a repulsive force between said shaft and said hub thereupon, comprising:

a body;

a groove extending through said body, said groove defining a groove outline and including a substantially straight bottom, said groove adapted to accept said shaft within said bottom of said groove;

clamping means for preventing relative motion of said body and said shaft when said shaft lies in said bottom of said groove;

a plurality of cylindrical bores in said body, each one of said bores parallel to said bottom of said groove, each one of said bores including a closed end within said body;

a plurality of longitudinal pistons, each one of said longitudinal pistons cylindrical and slidably engaging a corresponding one of said bores, each one said longitudinal piston extending from said corresponding one of said bores exteriorly of said body; and means for admitting pressurized fluid into each one of said bores between a corresponding one of said longitudinal pistons and a corresponding closed end for exerting said repulsive force between said body and said longitudinal pistons to move said longitudinal pistons in a direction parallel to said bottom of said groove, and away from said body;

whereby, when said shaft lies in said bottom of said groove, said longitudinal pistons may exert said repulsive force on said hub, and said hub may be moved relative to said shaft.

5. The remover as in claim 4 wherein said clamping means are actuated by said pressurized fluid, and said means for admitting pressurized fluid is adapted for admitting pressurized fluid to said clamping means.

6. The remover as in claim 5 wherein said clamping means includes radial pistons to press against said shaft.

7. The remover as in claim 4 wherein said clamping means includes screws engaging threaded holes in said body, said screws and said holes adapted to hold said shaft within said bottom of said groove upon turning of said screws, said screws and said holes perpendicular to and intersecting a shaft axis of said shaft when said shaft is held within said bottom of said groove.

8. The remover as in claim 4 wherein said longitudinal pistons are of equal area and are symmetrically distributed about a shaft axis of said shaft when said shaft lies in said bottom of said groove, whereby no torques are exerted upon said hub relative to said shaft.

9. The remover as in claim 8 wherein there are exactly two of said longitudinal pistons, said pistons disposed on either side of said groove.

10. The remover as in claim 8 wherein said body is cylindrical, and said shaft axis is colinear with a body axis of said body when said shaft lies in said bottom of said groove.

11. The remover as in claim 4 including a generally planar plate fixed to each of said longitudinal pistons exteriorly of said body, said plate generally perpendicular to said bottom of said groove; and an indentation in said plate defining an indentation outline congruent with said groove outline to pass said shaft therethrough when said shaft lies in said bottom of said groove; whereby said plate bears directly on said hub upon admission of pressurized fluid to said bores.

12. The remover as in claim 11 wherein said longitudinal pistons are of equal area and are symmetrically distributed about a shaft axis of said shaft when said shaft lies in said bottom of said groove, whereby no torques are exerted upon said hub relative to said shaft.

13. The remover as in claim 12 wherein there are exactly two of said longitudinal pistons, said longitudinal pistons disposed on either side of said groove.

14. The remover as in claim 12 wherein said body is cylindrical, and said shaft axis is colinear with a body axis of said body when said shaft lies in said bottom of said groove.

* * * * *